United States Patent [19]

Cauffiel

[11] 4,270,684

[45] Jun. 2, 1981

[54] APPARATUS FOR HANDLING SHEET STEEL OR THE LIKE

[76] Inventor: Ford B. Cauffiel, 1400 Hastings Ave., Toledo, Ohio 43607

[21] Appl. No.: 79,384

[22] Filed: Sep. 27, 1979

[51] Int. Cl.[3] ..... B65H 17/36

[52] U.S. Cl. ..... 226/162; 226/91; 226/166

[58] Field of Search ..... 226/91, 120, 125, 126, 226/158, 162–167; 72/287, 290–293; 271/42

[56] References Cited

U.S. PATENT DOCUMENTS

| | | | |
|---|---|---|---|
| 2,533,996 | 12/1950 | Clarkson | 242/76 |
| 2,929,626 | 3/1960 | Weymouth | 271/42 |
| 3,863,858 | 2/1975 | Cauffiel | 242/75.2 |

*Primary Examiner*—Leonard D. Christian
*Attorney, Agent, or Firm*—Allen D. Gutchess, Jr.

[57] ABSTRACT

Apparatus is provided for engaging and moving leading edges of coils of sheet steel from one position to another along a steel processing line. For example, in a slitting line, the leading edge of a new coil of steel is moved by the apparatus from a slitter to a recoiler mandrel or drum. The engaging apparatus includes two elongate clamping members extending transversely of the steel sheet and having lengths exceeding the width of the slit sheet. Jack-screws are used to move the upper member toward and away from the lower one to engage the leading edge of the sheet and to release it. The clamping members and moving means are mounted on a carriage carried by overhead supports or by supports at one side of the line which support the carriage for movement from one position on the processing line to another. A roller extends the length of the lower clamping member and is positioned at the discharge or downstream side thereof to support the steel sheet as it moves beyond the clamping members. The roller can also be used without the clamping members.

4 Claims, 4 Drawing Figures

APPARATUS FOR HANDLING SHEET STEEL OR THE LIKE

This invention relates to apparatus for handling sheet steel and more specifically for advancing the leading edge of the steel sheet of a new coil from one position to another along a steel processing line.

The apparatus according to the invention has particular utility in connection with a steel slitting line. In such a line, a wide sheet of steel from a coil is slit into a plurality of ribbons or strips and subsequently wound on a recoiler mandrel or drum. When a new coil of sheet steel is to be processed on the line, the leading edge is fed to the slitter where it is slit into the ribbons or strips. Heretofore, the leading edges of the ribbons or strips usually were hand carried and manipulated by a workman from the slitter station to the recoiler station. This was a laborious job, particularly with thicker steel sheet, and the slit edges of the ribbons frequently caused injuries.

The present invention provides apparatus for handling the leading edge of sheet steel and for moving it from one station to another along a steel processing line. For a slitting line, the apparatus engages the leading edges of the ribbons beyond the slitter and carries them by means of an overhead support to the recoiler mandrel or drum. In a press feed line, the apparatus engages the leading edge of sheet steel from the new coil and carries it from a tensioning device to a press, by way of example.

The moving and engaging apparatus includes a carriage unit having frame members supporting two elongate clamping members. These are positioned transversely to the sheet steel and have a length exceeding the width of the sheet. The carriage frame also has jack-screws which are simultaneously operated through suitable means to raise and lower the upper clamping member relative to the lower one. The clamping members thus can engage the leading edge portions of the sheet steel to move it from one position to another position along a steel processing line. For this purpose, the carriage unit is movably carried on a pair of overhead rails which extend between the two positions. The overhead rails are out of the way and do not interfere with the workmen on the processing line. However, side rails or floor rails at one side of the line with cantilevered supports can also be used. In either case, the apparatus is preferably equipped with drive means for moving the carriage unit between the positions.

It is, therefore, a principal object of the invention to provide improved apparatus for moving and engaging sheet steel and for carrying it from one position to another along a steel processing line.

Many other objects and advantages of the invention will be apparent from the following detailed description of a preferred embodiment thereof, reference being made to the accompanying drawings, in which.

Figure 1:
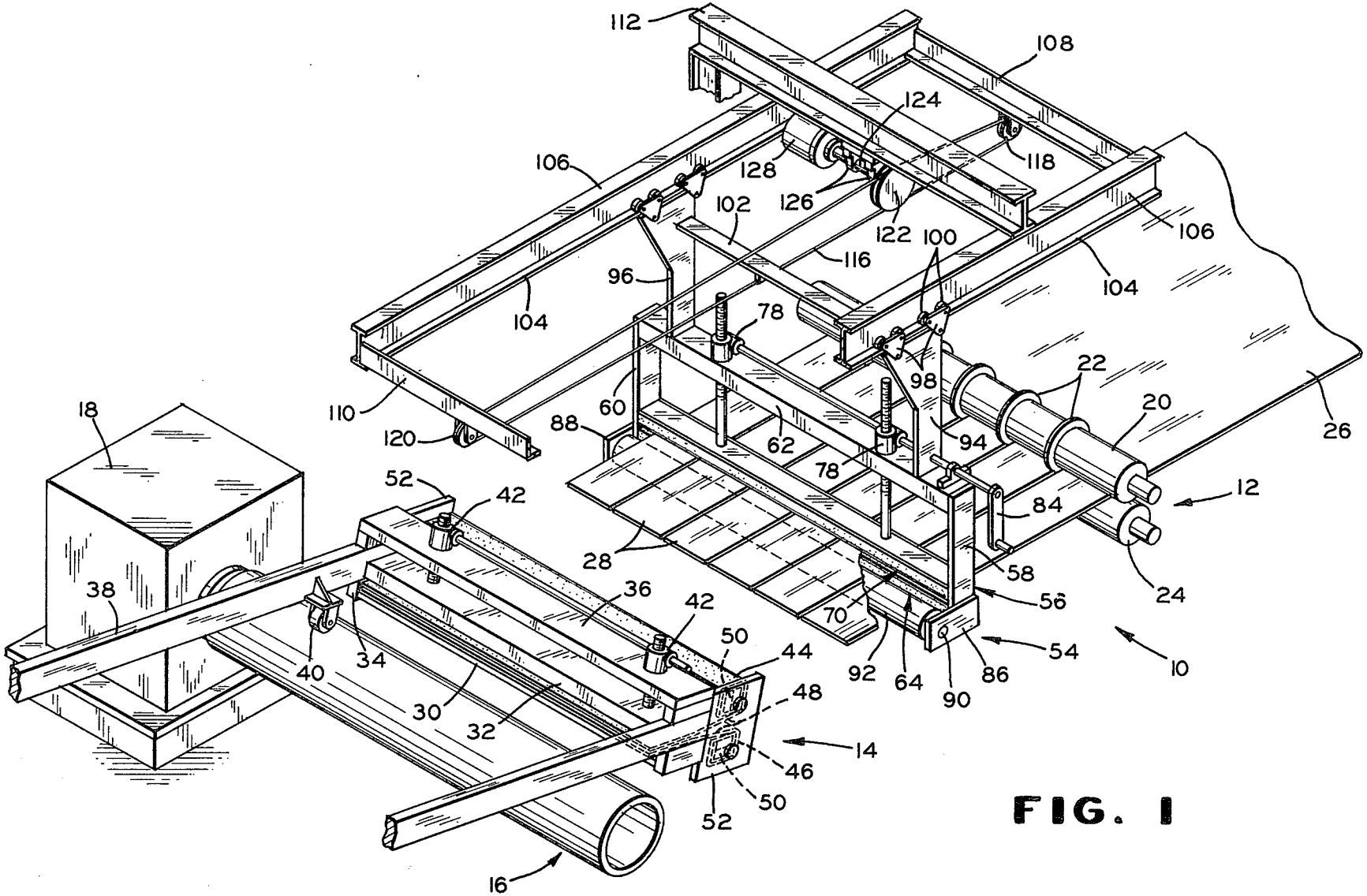
FIG. 1 is a fragmentary, somewhat schematic view in perspective of a steel slitting line employing a sheet steel handling unit in accordance with the invention.
Figure 2:
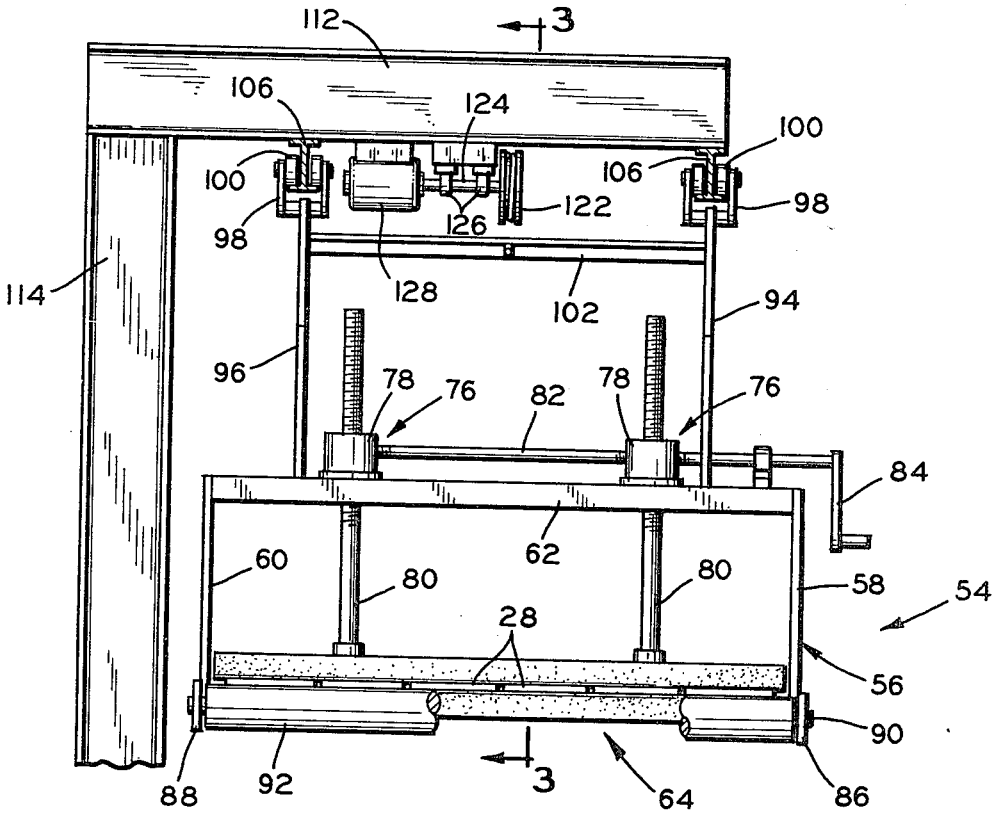
FIG. 2 is a front view in elevation of the sheet steel handling unit of FIG. 1.

Referring to FIG. 1, a sheet steel slitting line is indicated at 10. The line includes a slitter 12, a tensioning device 14, and a recoiler mandrel or drum 16 having a suitable drive 18. The slitter includes a slitter roller 20 with circular knives 22 and a backup roll 24. An elongate steel sheet 26 from a supply coil (not shown) is slit into a plurality of strips or ribbons 28 which then move through the tensioning device 14 and onto the mandrel 16.

The basic tensioning device can be similar to that shown in Cauffiel et al U.S. Pat. No. 3,863,858, issued Feb. 4, 1975, and will not be discussed in detail. It includes lower and upper tensioning members 30 and 32 carried by frame members 34 and 36. The frame members are mounted on two arms 38, only one of which is shown, which have rollers 40 riding on the ribbons being coiled so that the tensioning device moves up as the diameter of the coil increases. The upper tensioning member 32 can be moved toward and away from the lower member by jack-screws 42 to change the tension on the ribbons 28 being wound. The tensioning device 14 differs from that of the aforesaid patent in that it has upper and lower supplies 44 and 46 of carpet 48 or the like between which the ribbons 28 are fed. The supplies 44 and 46 include square cores 50 held on suitable brackets 52 in front of the tensioning members 30 and 32. As the carpeting between the tensioning members wears, the cores 50 simply are rotated ninety degress in the brackets 52 to supply new carpet to the tensioning members. Thus, a readily accessible and inexpensive new supply of carpet is always available.

When a new coil of sheet steel 26 is started, it is fed through the slitter 12 and then the leading edges of the ribbons 28 usually have been carried by a workman to the tensioning device 14, directed through the tensioning members 30 and 32, and affixed to the mandrel 16. This is laborious and time consuming, especially where thicker steel is being slit. The slit edges of the ribbons also can be dangerous and cut the workman's hands.

Figure 3:
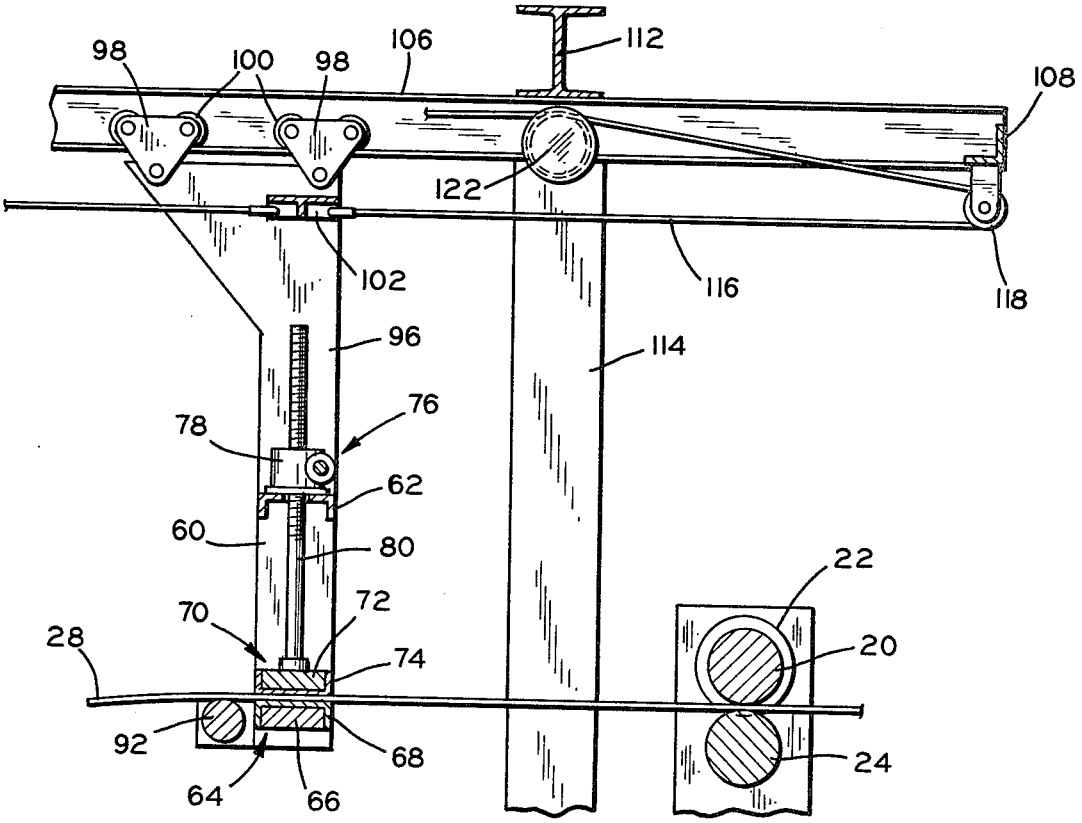
FIG. 3 is a view in transverse cross section taken along the line 3—3 of FIG. 2.

In accordance with the invention, a sheet handling unit indicated at 54 is provided. The unit includes a frame 56 comprising upright, end frame members 58 and 60 and an upper, horizontal frame member 62. A lower engagable member or elongate jaw 64 extends between lower end portions of the upright frame members 58 and 60 and includes a rigid bar 66 (FIG. 3) with a suitable covering 68 of carpeting or the like. Above the engagable member 64 is an upper engagable member or elongate jaw 70 comprising a rigid bar 72 with a suitable covering 74. Two jack-screws 76 are carried on the horizontal frame member 62 and include gear drives 78 and threaded rods 80 which are suitably affixed to the back of the upper engagable member 70. The jack-screws are operated by a common shaft 82 to raise and lower the engagable member 70 equally along its length. The shaft 82 can extend beyond the frame member 58 where it can be rotated by a crank 84. Alternately, the end of the shaft 82 can be square and operated by a pneumatic drill or the like.

The lower ends of the frame members 58 and 60 have brackets 86 and 88 which receive an axle 90 of a roller 92 which extends at least the length of the engagable members 64 and 70. The roller 92 is important in supporting the ribbons 28 so that they do not bend excessively and kink. This is particularly true for lighter gage steel.

In order to move the engagable members 64 and 70 with the leading edges of the ribbon 28 from a position near the slitter 12 to a position near the mandrel 16, hanger plates 94 and 96 extend upwardly from spaced portions of the frame member 62. The plates are wider at the top where they are connected to brackets 98 carrying rollers 100. The plates are also maintained in spaced relationship by an upper horizontal strut 102. The rollers 100 engage lower flanges 104 of rails or beams 106, the ends of which terminate near the slitter 12 and near the mandrel 16. The rails, in turn, are maintained in spaced relationship by ends struts 108 and 110 and are suitably supported by overhead beams 112 and upright beams 114. This supporting structure is located entirely at one side of the slitter line so that it does not interfere with workmen along the line.

The unit 54 can be moved along the rails 106 by hand to move the leading edge portions of the ribbons 28 from the slitter to the mandrel after they are clamped by the engagable members 64 and 70. If desired, the unit can also be powered, as shown in the drawings. For this purpose, a cable 116 has ends connected to the cross strut 102 and extends around end pulleys 118 and 120. The cable is then wrapped several times around a driven pulley 122 which is driven by a shaft 124. The shaft 124 is supported by bearing blocks 126 below the beam 112 and is driven by a suitable motor 128.

In the operation of the handling unit 54, when a new steel sheet 26 is needed, the leading edge is fed from the coil through the slitter 12 until the ends extend far enough that they can be engaged by the engagable members 64 and 70. The ribbons should extend far enough that they can be fed through the tensioning device 14 and wound onto the mandrel 16 when the unit 54 is adjacent the tensioning device. With the ribbons in proper position, the jack-screws are operated to clamp the ribbons firmly between the members 64 and 70. The motor 128 can then be started to move the ribbons toward the mandrel 16. During this time, the slitter is operated to continue slitting the sheet 26. The leading edges are then fed between the tensioning members 30 and 32 and suitably affixed to the mandrel. The slitter line with the new steel sheet can then be operated in the usual manner.

From the above, it will be seen that the handling unit according to the invention has a number of advantages. The ribbons can be threaded with minimum handling by workmen and the weight of the ribbons is carried by the unit. With the overhead supporting structure, there is nothing in the way of the workmen when the line is in operation.

Figure 4:
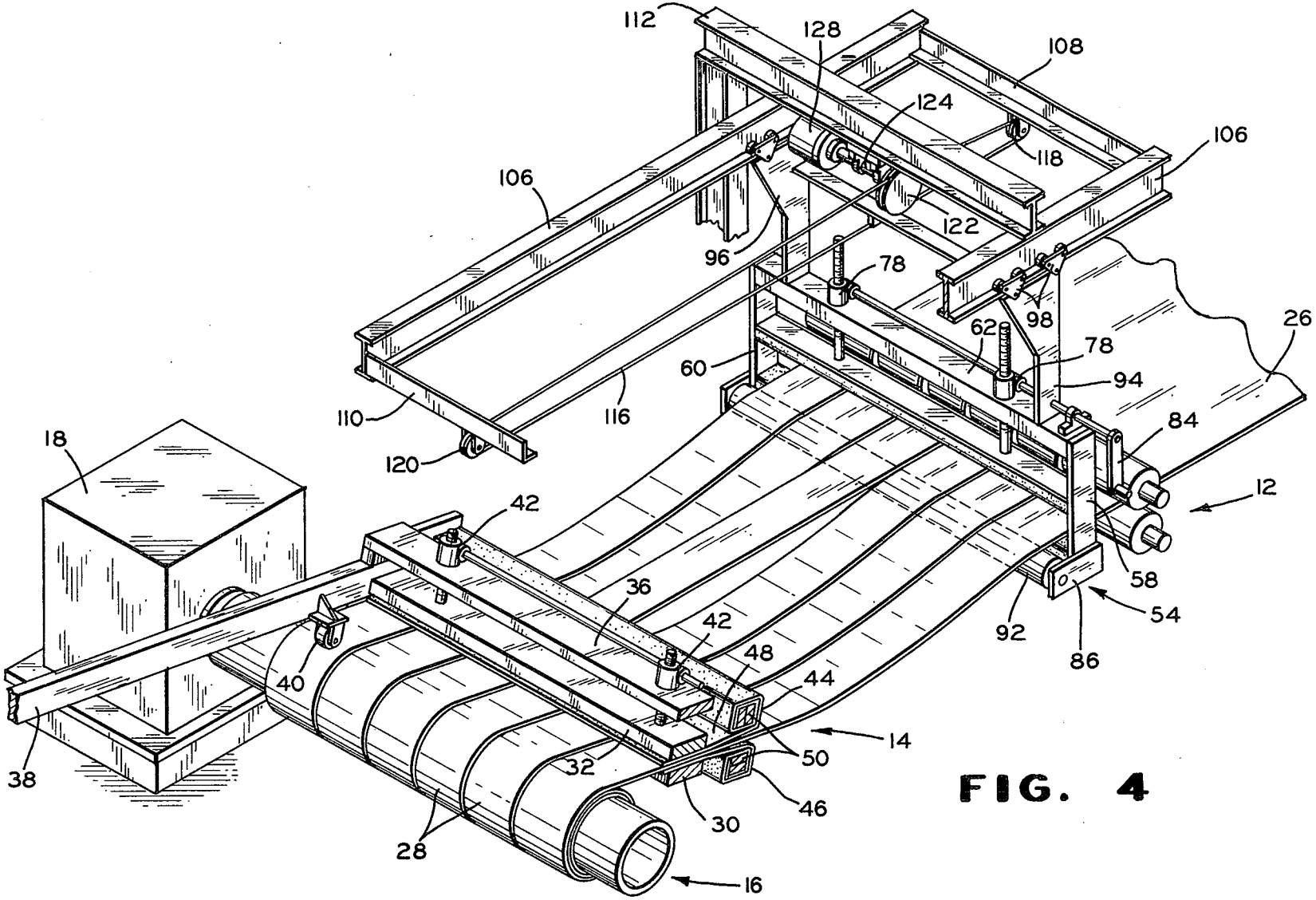
FIG. 4 is a view in perspective similar to FIG. 1 showing the steel slitting line in operation.

When the slitter line is in operation, the handling unit 54 can be moved back adjacent the slitter 12, as shown in FIG. 4. The upper engagable member is then raised so that it will not interfere with the ribbons. At the same time, the ribbons can be partially supported on the roller 92 to prevent undue bending. As shown, slight variations in the thickness of the steel from one edge to the other can cause the ribbons to be recoiled at different rates due to the difference in diameters. Hence, the more slack ribbons are supported on the roller 92.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. Apparatus for engaging and moving a leading edge of an elongate sheet of a coil from one position to another position along a processing line, said apparatus comprising a carriage having a frame, two parallel, elongate engagable members mounted on said frame, one above the other, and extending transversely of the sheet, with the lengths of said engagable members exceeding the width of the sheet, means for moving the upper one of said engagable members toward and away from the lower one to engage the strip between the lower surface of said upper engagable member and the upper surface of said lower engagable member while maintaining the parallel relationship between the members, rail means located above the lower engagable member for supporting said carriage for movement between the two positions of the processing line, power means associated with said rail means for moving said carriage between the two positions of the line, and a roller carried by said frame immediately downstream of said lower engagable member, said roller having a length exceeding the width of the sheet, said roller being parallel to said lower engagable member and having its uppermost peripheral surface substantially in a horizontal plane with the upper surface of said lower engagable member.

2. Apparatus according to claim 1 characterized by said moving means comprising at least two jack-screws connected to spaced portions of said upper engagable member, and means connected between said two jack-screws for simultaneously rotating said jack-screws.

3. Apparatus for engaging and moving leading edges of ribbons slit from an elongate sheet of steel from a slitter to a recoiler along a slitter line, said apparatus comprising a carriage having a frame, two elongate jaws mounted on said frame, one above the other, and extending transversely of the ribbons, with the length of said jaws exceeding the width of the ribbons, a lower surface of the upper jaw being parallel to an upper surface of the lower jaw, means for moving the upper one of said jaws toward and away from the lower one to clamp the leading edges of the ribbons therebetween, means located above the lower jaw for supporting said carriage for movement between a position adjacent the slitter and a position adjacent the recoiler, power means for moving said carriage between the two positions of the slitter line, a roller carried by said frame immediately downstream of said lower jaw, said roller being parallel to said lower jaw, and having its uppermost peripheral surface in substantially a common horizontal plane with the upper surface of said lower jaw.

4. Apparatus according to claim 3 characterized by said moving means comprising at least two jack-screws rotatably carried by said frame and having ends connected to spaced portions of said upper jaw, means connected between said jack-screws, and means for operating said connecting means to simultaneously rotate said jack-screws.

* * * * *